US008276497B2

(12) United States Patent
Hunn

(10) Patent No.: US 8,276,497 B2
(45) Date of Patent: Oct. 2, 2012

(54) BLAST ATTENUATOR AND METHOD OF MAKING SAME

(75) Inventor: David L. Hunn, Kennedale, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 998 days.

(21) Appl. No.: 11/371,703

(22) Filed: Mar. 9, 2006

(65) Prior Publication Data

US 2012/0180627 A1 Jul. 19, 2012

(51) Int. Cl.
*F41H 5/04* (2006.01)

(52) U.S. Cl. ..... 89/36.02; 89/903

(58) Field of Classification Search ..... 89/36.02, 89/903

See application file for complete search history.

(56) References Cited

U.S. PATENT DOCUMENTS

| | | | | |
|---|---|---|---|---|
| 2,360,525 | A | 10/1944 | Sperry | |
| 2,401,247 | A | 5/1946 | Hunter | |
| 3,431,818 | A * | 3/1969 | King | 89/36.02 |
| 4,905,320 | A * | 3/1990 | Squyers, Jr. | 2/22 |
| 5,394,786 | A * | 3/1995 | Gettle et al. | 86/50 |
| 6,418,832 | B1 * | 7/2002 | Colvin | 89/36.02 |
| 6,619,727 | B1 | 9/2003 | Barz et al. | |
| 6,630,249 | B2 | 10/2003 | Kennedy | |
| 6,698,331 | B1 * | 3/2004 | Yu et al. | 89/36.02 |
| 6,701,529 | B1 * | 3/2004 | Rhoades et al. | 2/2.5 |
| 7,444,946 | B2 | 11/2008 | Rodney et al. | |
| 2006/0054013 | A1 * | 3/2006 | Rodney et al. | 89/36.02 |
| 2006/0234577 | A1 * | 10/2006 | Wagner et al. | 442/135 |

OTHER PUBLICATIONS

Chhabra, R.P., et al., "Chapter 1; Non-Newtonian fluid behavior," *Non-Newtonian Flow and Applied Rheology, Engineering Applications*, 2nd Ed., Oxford, UK, Butterworth-Heinemann, 2008, pp.1-36.

ERG Materials and Aerospace Corporation, "Duocel Aluminum Foam," http://www.ergaerospace.com/duocel/aluminum.shtml, Feb. 23, 2006, pp. 1-4.

ERG Materials and Aerospace Corporation, "Duocel Aluminum Foam in Energy Absorption," http://www.ergaerospace.com/literature/energy.shtml, Feb. 23, 2006, pp. 1-6.

Subramanian, R., "Non-Newtonian Flows," Department of Chemical and Biomolecular Engineering, Clarkson University, http://web2.clarkson.edu/projects/subramanian/ch330/notes/Non-Newtonian%20Flows.pdf, 5 pages.

* cited by examiner

*Primary Examiner* — Stephen M Johnson
(74) *Attorney, Agent, or Firm* — Slater & Matsil, LLP

(57) ABSTRACT

A blast attenuator includes an enclosure defining a cavity; a core defining a plurality of interconnected pores, the core disposed in the cavity; and a shear thickening fluid disposed in the cavity, such that the shear thickening fills a portion of a pore volume of the core. A blast attenuation assembly includes a blast attenuator including a shear thickening fluid and a crushable element that omits a shear thickening fluid operably associated with the blast attenuator. A method includes the steps of providing a rigid core defining a plurality of interconnected pores and placing an enclosure about the core, the enclosure defining a filling port. The method further includes the steps of filling at least a portion of a pore volume of the core with a shear thickening fluid and closing the filling port to seal the enclosure and form a first blast attenuator.

17 Claims, 6 Drawing Sheets

FIG. 12
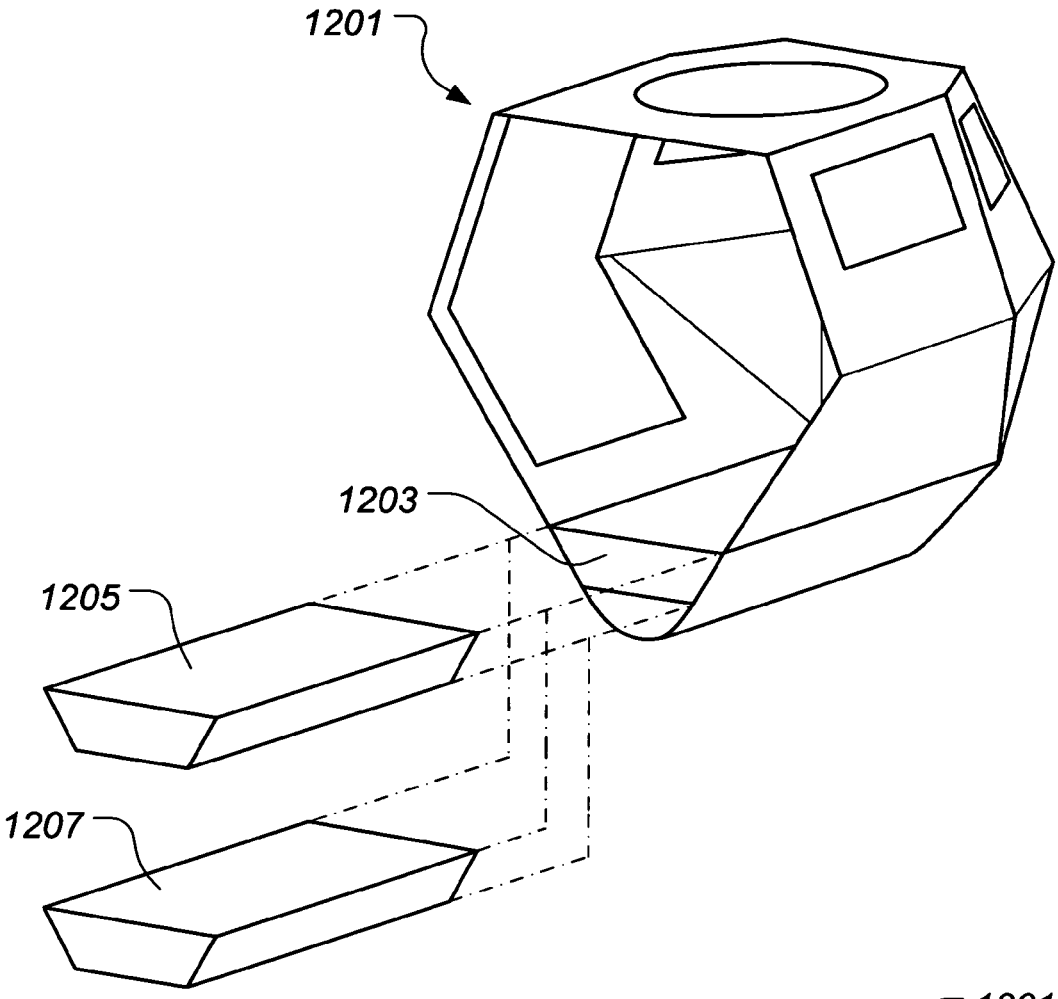
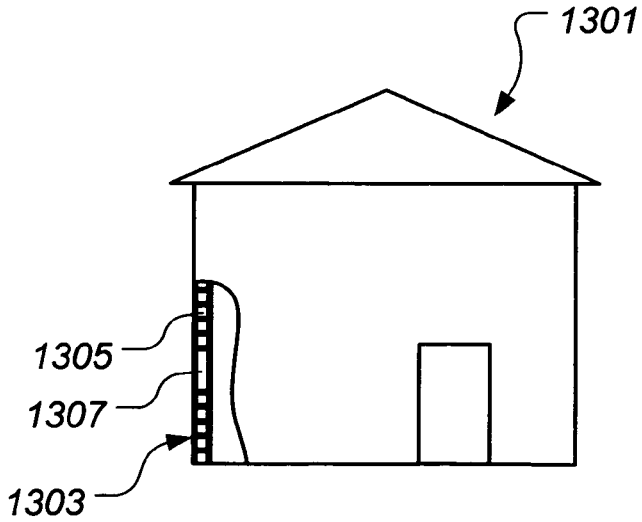
FIG. 13

BLAST ATTENUATOR AND METHOD OF MAKING SAME

BACKGROUND

1. Field of the Invention

The present invention relates to explosive blast attenuation devices.

2. Description of Related Art

In combat situations, such as in military, police, and/or armored transport operations, it is desirable to protect vehicles, such as tanks, personnel carriers, trucks, and the like, as well as the vehicle's contents, from damage by blasts resulting from detonated explosive devices. Accordingly, such vehicles are known to have elements, such as blast attenuators, that absorb and/or redistribute a blast impulse to reduce the likelihood that the blast will cause penetration of the vehicle. If the blast wave and/or associated spall or shrapnel penetrate the vehicle, the occupants of the vehicle may be injured or the vehicle's ability to operate may be impaired. It is similarly important to protect buildings and other such structures from the deleterious effects of explosive blasts.

One way of at least partially protecting a vehicle and the like from the destructive effects of explosive blasts is to provide armor on the exterior of the vehicle. Such armor typically is made from thick steel plate, which increases the weight of the vehicle substantially. The armor must be sufficiently strong to prevent the blast wave resulting from the explosive blast from penetrating or rupturing the armor.

Another way of protecting vehicles and the like from the destructive effects of explosive blasts is to add crushable elements to the vehicle. Typical crushable elements used in blast attenuators include, for example, honeycomb, foam, and/or corrugated panels that absorb the explosive blast wave. While such crushable elements are effective in absorbing blast loads, they are volumetrically inefficient. Crushable elements having large volumes are required to dissipate the energy of the explosive blast.

While protecting the vehicle or structure and its occupants and equipment is generally of primary importance, other factors may play a role in the design of blast attenuators for the vehicle. For example, it is not desirable for the vehicle's overall size to increase greatly as a result of adding blast attenuators or other such blast protection devices to the vehicle. It is logistically important for existing transportation equipment (e.g., trucks, trailers, aircraft, and the like) to be capable of transporting the vehicle. If the size of the vehicle is increased over previous vehicles, the existing transportation equipment may not be capable of transporting the vehicle, or the existing transportation equipment may be limited to carrying fewer vehicles per load. Additionally, it is desirable to maximize the internal volume of the vehicle to allow adequate space to house the crew and crew gear. Accordingly, blast attenuators having lower volumes generally result in vehicle designs having larger internal volumes. The overall size of the vehicle is also a factor in combat situations. Generally, smaller targets (i.e., smaller vehicles) are more difficult to hit with artillery, such as rockets, mortars, missiles, and the like. Thus, it is desirable for the vehicle's overall size to be smaller, rather than larger, to reduce the likelihood of an artillery hit or explosive impact.

There are many designs of blast attenuators that are well known in the art; however, considerable shortcomings remain.

SUMMARY OF THE INVENTION

There is a need for an improved blast attenuator.

Therefore, it is an object of the present invention to provide an improved blast attenuator and a method of making the blast attenuator.

These and other objects are achieved by providing a blast attenuator, including an enclosure defining a cavity; a core defining a plurality of interconnected pores, the core disposed in the cavity; and a shear thickening fluid disposed in the cavity, such that the shear thickening fills a portion of a pore volume of the core.

In another aspect, the present invention provides a blast attenuation assembly. The blast attenuation assembly includes a blast attenuator including a shear thickening fluid and a crushable element that omits a shear thickening fluid operably associated with the blast attenuator.

In yet another aspect of the present invention, a method is provided. The method includes the steps of providing a rigid core defining a plurality of interconnected pores and placing an enclosure about the core, the enclosure defining a filling port. The method further includes the steps of filling at least a portion of a pore volume of the core with a shear thickening fluid and closing the filling port to seal the enclosure and form a first blast attenuator.

In another aspect, the present invention provides a method including the steps of providing a blast attenuator including a shear thickening fluid, providing a crushable element that omits a shear thickening fluid, and operably associating the blast attenuator and the crushable element.

The present invention provides significant advantages, including: (1) providing lower cost means for attenuating explosive blasts than conventional thick armor or conventional crushable elements; (2) providing lighter weight means for attenuating explosive blasts than conventional thick armor; and (3) providing lower volume means for attenuating explosive blasts than conventional crushable elements.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote (s) the first figure in which the respective reference numerals appear; wherein:

FIG. 12 is a partially exploded, perspective view of a vehicle cab including at least one of a blast attenuator and a blast attenuation assembly according to the present invention; and FIG. 13 is a side, elevational view of a building including at least one of a blast attenuator and a blast attenuation assembly according to the present invention.

Figure 1:
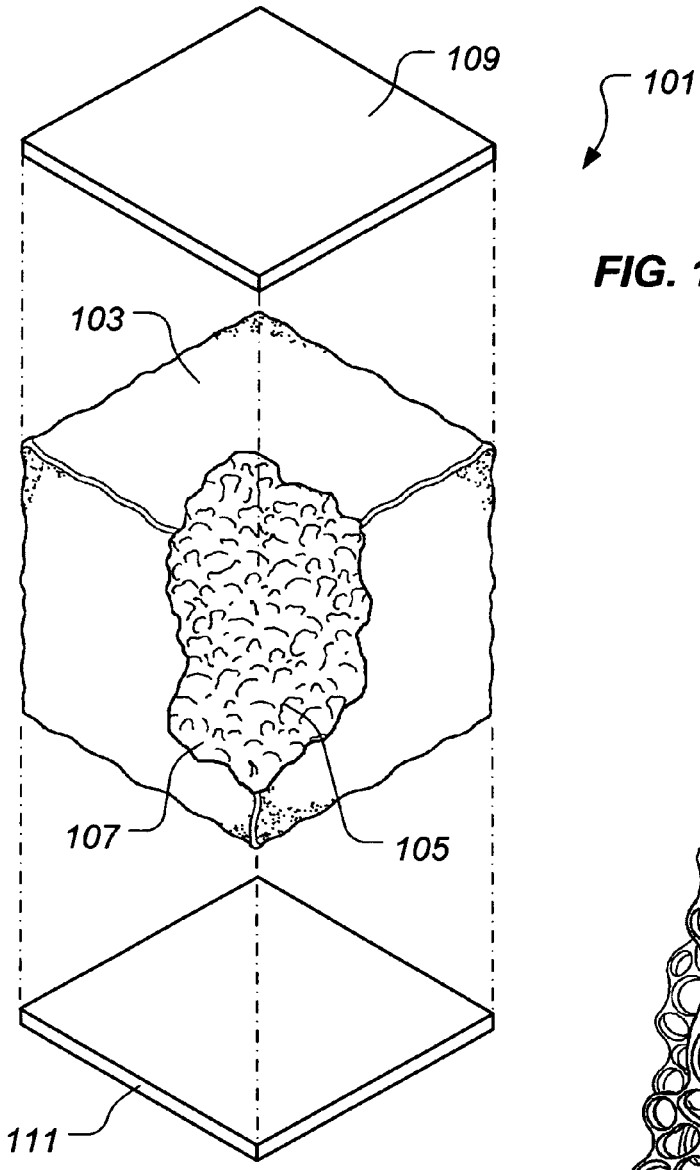
FIG. 1 is a partially exploded, perspective view of first illustrative embodiment of a blast attenuator according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

It should be appreciated that the following terms and phrases are intended to have a particular meaning throughout the following detailed description. The term "open-celled foam," as it relates to the present disclosure, means a cellular structure containing a large volume fraction of pores forming an interconnected network. In this disclosure, the terms "foam" and "sponge" are used interchangeably.

The present invention represents a blast attenuator for lessening the destructive effects of blasts resulting from the detonation of explosive devices, such as mines, improvised explosive devices, bombs, and the like. Generally, the blast attenuator of the present invention comprises a core comprising a plurality of interconnected pores. Preferably, the core comprises a metallic material. A shear thickening fluid fills at least a portion of the pore volume of the core. The core and the shear thickening fluid are contained within an enclosure. In some embodiments, a spall liner is disposed adjacent a back surface of the enclosure and, thus, is operably associated with the blast attenuator. Moreover, in some embodiments, a face sheet is disposed adjacent a front surface of the core and, thus, is operably associated with the blast attenuator. In use, the armor is oriented such that a blast wave resulting from a detonated explosive device or a ballistic round will preferably encounter the face sheet first, if the face sheet is provided.

FIG. 1 depicts a perspective view of a first illustrative embodiment of a blast attenuator 101 according to the present invention. It should be noted, however, that, in various embodiments, the blast attenuator of the present invention may take on many different forms and implementations. In the illustrated embodiment, blast attenuator 101 comprises an enclosure 103 housing a core 105 defining a plurality of interconnected pores and a dilatant or shear thickening fluid 107 filling at least a portion of a pore volume of core 105. Enclosure 103 retains shear thickening fluid 107 therein until blast attenuator 101 encounters an explosive blast wave, as will be discussed in greater detail below.

Figure 2:
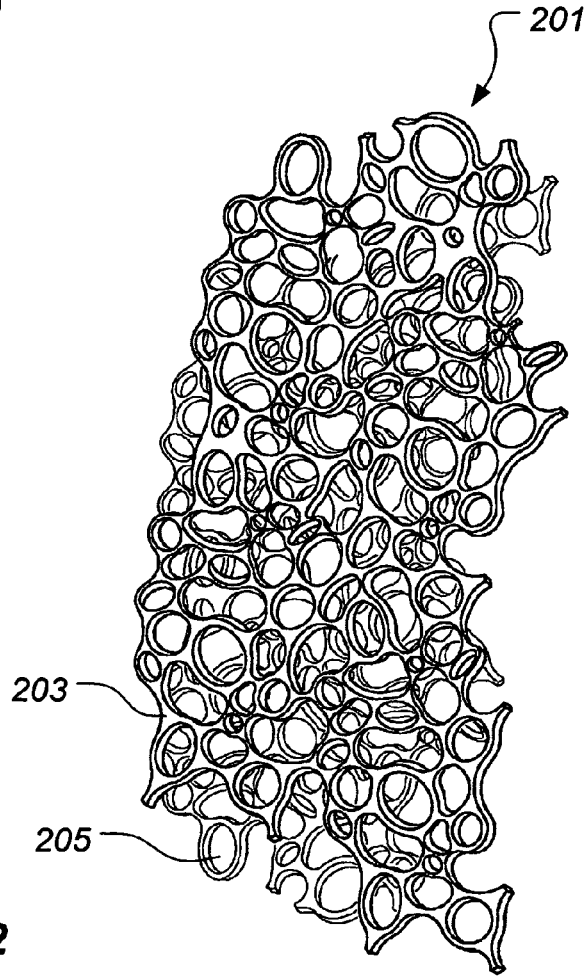
FIG. 2 is a perspective view of an exemplary metallic foam of one particular embodiment of the blast attenuator of FIG. 1.

Preferably, core 105 comprises an open-celled foam. More preferably, core 105 comprises an open-celled metallic foam, such as an exemplary metallic foam 201 of FIG. 2. The metallic foam may comprise aluminum, aluminum alloyed with one or more other elements, titanium, titanium alloyed with one or more other elements, stainless or other corrosion-resistant steel, or the like. Other materials may be employed in core 105, so long as core 105 exhibits a compressive strength of at least about 400 kilopascals and a density of at least about 120 kilograms per cubic meter.

Core 105 comprises a structural network defining a plurality of interconnected pores. Such a configuration is exemplified in metallic foam 201 of FIG. 2. Metallic foam 201 comprises, in this particular embodiment, a structural network 203 defining a plurality of interconnected pores 205 (only one labeled for clarity). In other words, some, and in some instances all, of the plurality of pores 205 are in fluid communication with one another. As such, a fluid may flow from one pore 205 to an adjacent pore 205, and so on.

A pore volume of core 105 corresponds to the individual volumes of the plurality of pores 205, in the aggregate, bounded by enclosure 103. In other words, the pore volume of core 105 corresponds to the volume of enclosure 103 less the volume of structural network 203. According to the present invention, shear thickening fluid 107 fills at least a portion of the pore volume of core 105 and is retained within the pores, such as pores 205, by enclosure 103. Preferably, shear thickening fluid 107 fills a majority of the pore volume of core 105 and, more preferably, shear thickening fluid 107 fills substantially all of the pore volume of core 105.

Generally, shear thickening or dilatant fluids are non-Newtonian fluids that exhibit increasing viscosities with increasing shear rates. For example, a shear thickening fluid, when manipulated at a low shear rate, exhibits low viscosity and acts as a liquid. When manipulated at a high shear rate, however, the shear thickening fluid exhibits high viscosity and acts more like a solid. Shear thickening fluids exhibit no yield stress.

It is believed that, at rest, few voids exist in the shear thickening fluid and the liquid present is sufficient to fill the void space. At low shear rates, the liquid lubricates the motion of each particle past others and the resulting stresses are consequently small. At high shear rates, however, the shear thickening fluid expands or dilates slightly, so that there is no longer sufficient liquid to fill the increased void space and prevent direct solid-solid contacts, which results in increased friction and higher shear stresses. It is believed that this mechanism causes the apparent viscosity to rise rapidly with increasing rate of shear. Examples of shear thickening fluids (e.g., shear thickening fluid 107) include, but are not limited to, dispersions of cornstarch in water, dispersions of silica in ethylene glycol, dispersions of clays in water, dispersions of titanium dioxide in water, and dispersions of silica in water.

Preferably, in at least one embodiment, shear thickening fluid 107 comprises silica particles dispersed in ethylene glycol. More preferably, the silica particles exhibit diameters of at least 200 nanometers. Moreover, it is preferable for shear thickening fluid 107 to exhibit a volume fraction of silica particles of at least about 0.4. The composition of shear thickening fluid 107 employed in blast attenuator 101 is implementation specific, depending at least upon the velocity, intensity, etc. of the explosive blast wave that blast attenuator 101 is expected to encounter. It should be noted that blast attenuator 101 may comprise any suitable shear thickening fluid 107.

Still referring to FIG. 1, blast attenuator 101 may include an optional face sheet 109 and/or an optional spall liner 111. Preferably, face sheet 109, if present, comprises a material that will, to some degree, impede the progress of the explosive blast wave and/or objects propelled by the explosive blast wave, such as shrapnel. Moreover, it is preferable for face sheet 109 to comprise a material that will, to some degree, impede the progress of a ballistic projectile, such as a bullet or round. Accordingly, face sheet 109, if present, is disposed between enclosure 103 and an anticipated explosive blast, such that a blast wave resulting from the explosive blast and or shrapnel propelled by the blast wave encounters face sheet 109 prior to encountering enclosure 103. Moreover, face sheet 109, if present, is preferably disposed such that a ballistic projectile will strike face sheet 109 prior to encountering blast attenuator 101.

In various embodiments, for example, face sheet 109 comprises titanium; titanium alloyed with one or more other elements; aluminum; aluminum alloyed with one or more other elements; an organic-matrix composite material, such as, for example, graphite-, carbon-, or fiberglass-reinforced epoxy composite material; a metal-matrix composite material, such as carbon-, silicon carbide-, or boron-reinforced titanium or aluminum composite material; a laminated material, such as titanium/aluminum laminate; or the like. Preferably, face sheet 109 comprises titanium; titanium alloyed with one or more other elements; aluminum; aluminum alloyed with one or more other elements; an organic-matrix composite material, such as, for example, graphite-, carbon-, or fiberglass-reinforced epoxy composite material; a laminated material, such as titanium/aluminum laminate; or the like.

Preferably, spall liner 111, if present, comprises a material that will drastically reduce the velocity of spall (e.g., shrapnel and the like) exiting blast attenuator 101. Accordingly, spall liner 111 may be disposed adjacent any surface of enclosure 103 from which spall is expected to exit. More preferably, spall liner 111 comprises a material that will substantially prevent the spall from exiting blast attenuator 101. For example, in various embodiments, spall liner 111 comprises one of the materials disclosed above of which face sheet 109 is comprised. Preferably, spall liner 111 comprises titanium; titanium alloyed with one or more other elements; aluminum; aluminum alloyed with one or more other elements; an organic-matrix composite material, such as, for example, graphite-, carbon-, or fiberglass-reinforced epoxy composite material; polyethylene; a laminated material, such as titanium/aluminum laminate; or the like. It should be noted, however, that the particular compositions of face sheet 109 and spall liner 111 are implementation specific. Accordingly, the present invention contemplates faces sheets (e.g., face sheet 109) and spall liners (e.g. spall liner 111) comprising any material suitable for a particular implementation.

Figure 3:
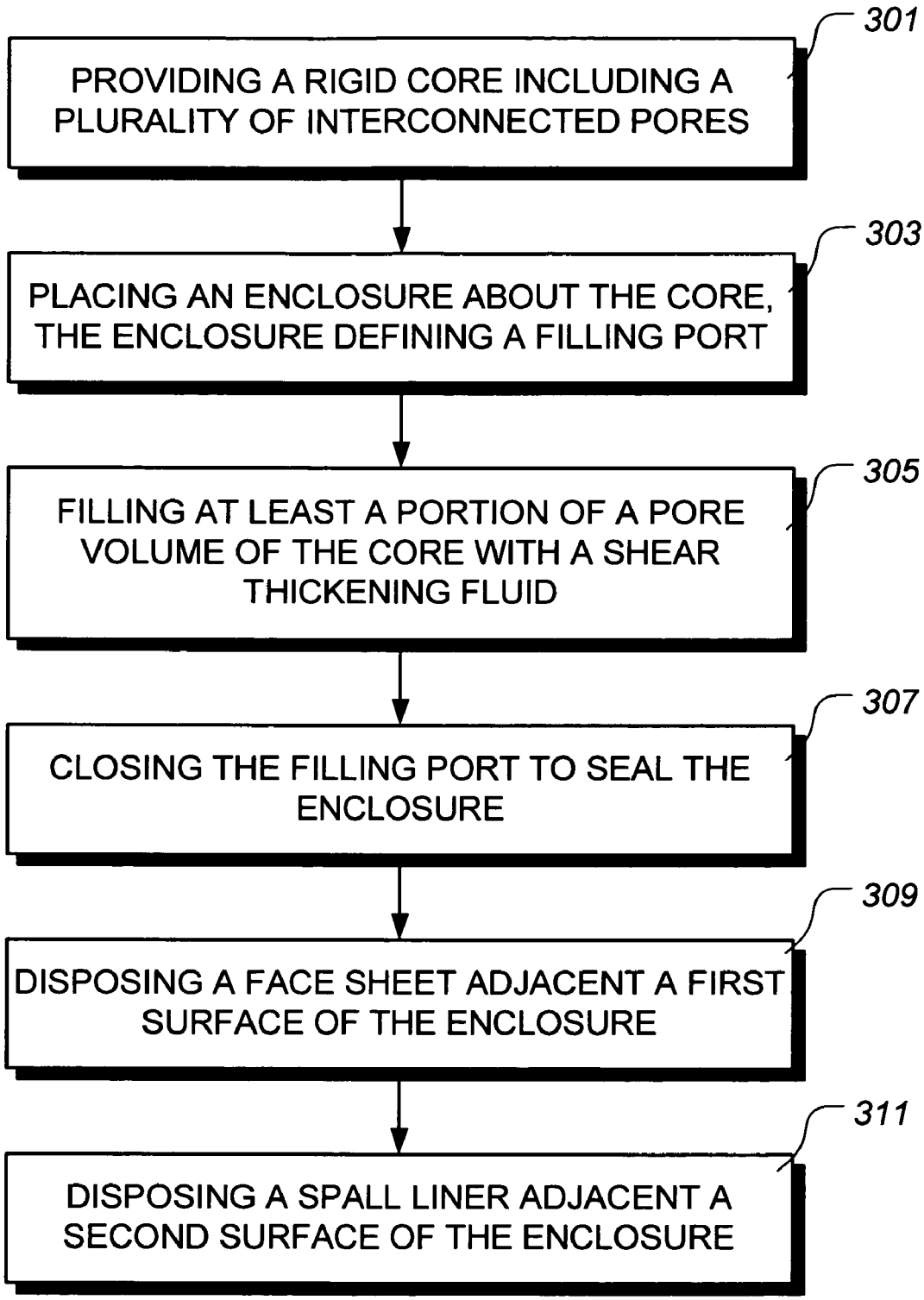
FIG. 3 is a block diagram illustrating one particular embodiment of a method of making a blast attenuator according to the present invention.

FIG. 3 illustrates one particular embodiment of a method of making a blast attenuator (e.g., blast attenuator 101) according to the present invention. In the illustrated embodiment, the method includes the step of providing a rigid core comprising a plurality of interconnected pores (block 301) and the step of placing an enclosure about the core, wherein the enclosure defines a filling port (block 303). The method further includes the step of filling at least a portion of a pore volume of the core with a shear thickening fluid (block 305) and closing the filling port to seal the enclosure (block 307). In some embodiments, the method further includes the step of disposing a face sheet (e.g., face sheet 109) adjacent a first surface of the enclosure (block 309) and/or the step of disposing a spall liner (e.g., spall liner 111) adjacent a second surface of the enclosure (block 311). It should be noted that the scope of the present invention, however, includes embodiments wherein one or both of the steps depicted in blocks 309 and 311 are omitted.

Figure 4:
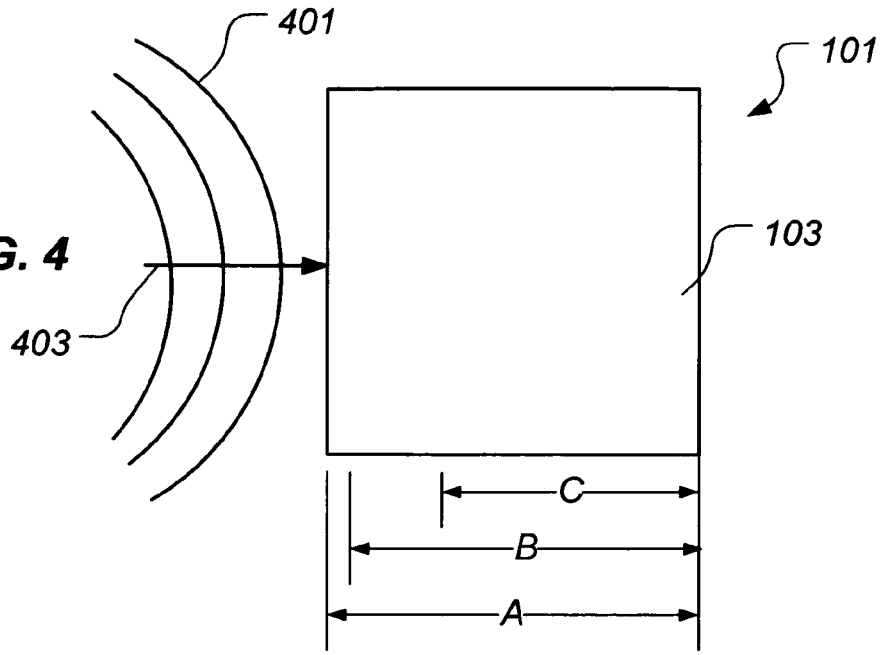
FIG. 4 is a stylized schematic illustrating one particular operation of a blast attenuator according to the present invention.

FIG. 4 provides a stylized schematic illustrating one particular operation of blast attenuator 101. Explosive blast wave 401 imparts an impact force, represented by an arrow 403, to blast attenuator 101. Impact force 403 compresses blast attenuator 101 from an original dimension A to, for example, a compressed dimension B. As blast attenuator 101 is compressed, shear thickening fluid 107 (shown in FIG. 1) is subjected to high rates of shear. Accordingly, shear thickening fluid 107 exhibits an increased viscosity and, preferably, becomes at least semi-rigid while shear thickening fluid 107 is subjected to high shear rates, at least partially attenuating the energy of impact force 403. As the intensity of impact force 403 subsides, shear thickening fluid 107 is subjected to lower and lower rates of shear. Accordingly, shear thickening fluid 107 exhibits decreasing viscosities corresponding to the lower rates of shear. If impact force 403 is sufficient in duration after subsiding in intensity, such that shear thickening fluid 107 behaves as a liquid, blast attenuator 101 is further compressed, for example, from dimension B to dimension C. Depending upon the intensity of impact force 403, enclosure 103 is ruptured and shear thickening fluid 107 flows from within enclosure 103 through the rupture. It should be noted that, depending upon the magnitude and orientation of impact force 403, blast attenuator 101 will compress in directions other than those indicated in FIG. 4 and enclosure 103 will rupture prior to shear thickening fluid 107 again behaving as a liquid.

Figure 5:
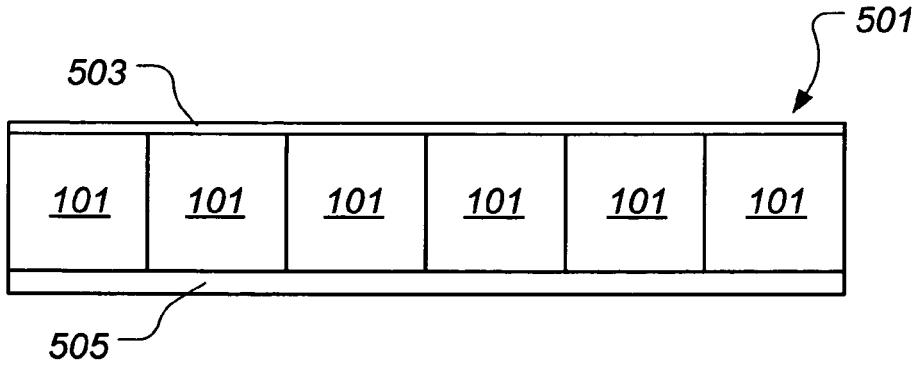
FIG. 5 is a side, elevational view of a first illustrative embodiment of a blast attenuation assembly according to the present invention.

FIG. 5 depicts a first illustrative embodiment of a blast attenuation assembly 501 according to the present invention. In the illustrated embodiment, blast attenuation assembly 501 comprises a plurality of blast attenuators 101. Preferably, blast attenuation assembly 501 includes a face sheet 503 and a spall liner 505, corresponding to face sheet 109 and spall liner 111 of FIG. 1. Face sheet 503 and/or spall liner 505, however, may be omitted in certain embodiments.

Figure 6:
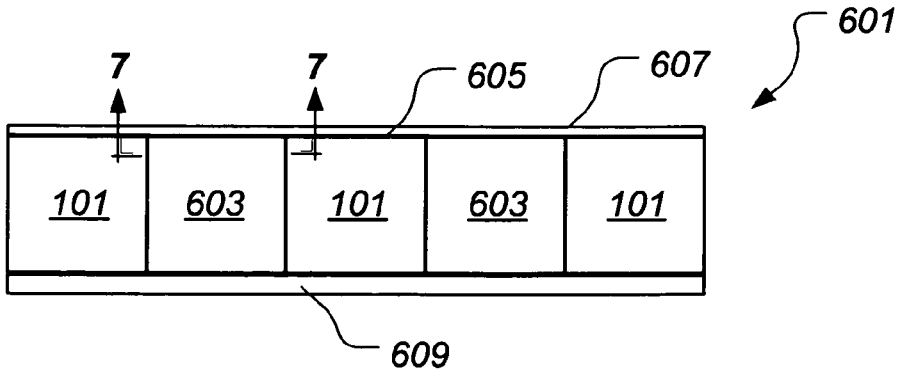
FIG. 6 is a side, elevational view of a second illustrative embodiment of a blast attenuation assembly according to the present invention.
Figure 7:
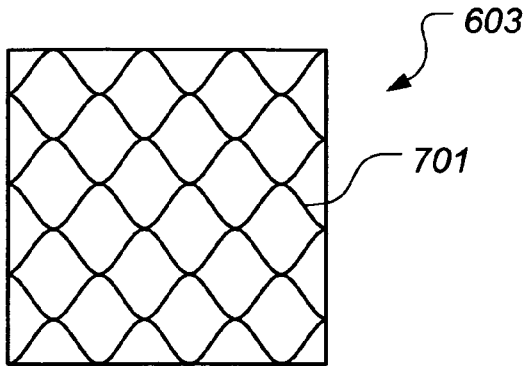
FIG. 7 is across-sectional view of one particular embodiment of a crushable element of the blast attenuation assembly of FIG. 6, taken along the line 7-7 in FIG. 6.

FIG. 6 depicts a second illustrative embodiment of a blast attenuation assembly 601 according to the present invention. In the illustrated embodiment, blast attenuation assembly 601 comprises at least one blast attenuator 101 disposed adjacent a crushable element 603 to define a blast-facing surface 605. Crushable element 603, however, omits shear thickening fluid 107. In the embodiment of FIG. 6, a plurality of blast attenuators 101 are interposed with a plurality of crushable elements 603. Blast attenuators 101 and crushable elements 603 attenuate impact forces, such as impact force 403 of FIG. 4. However, as discussed above, blast attenuators 101 attenuate the impact forces to a greater degree than crushable elements 603, because of shear thickening fluid 107. Crushable elements 603 comprise, in various embodiments, honeycomb, open-celled foam, closed-cell foam, and/or corrugations. One example of such a corrugation is a corrugated web 701 (only one indicated for clarity), shown in FIG. 7. Preferably, blast attenuation assembly 601 includes a face sheet 607, disposed adjacent blast-facing surface 605, and a spall liner 609. Face sheet 607 and spall liner 609 correspond to face sheet 109 and spall liner 111, respectively, of FIG. 1. Face sheet 607 distributes impact forces, such as impact force 403 of FIG. 4, to blast attenuators 101 and crushable elements 603. Face sheet 607 and/or spall liner 609, however, may be omitted in certain embodiments.

Figure 8:
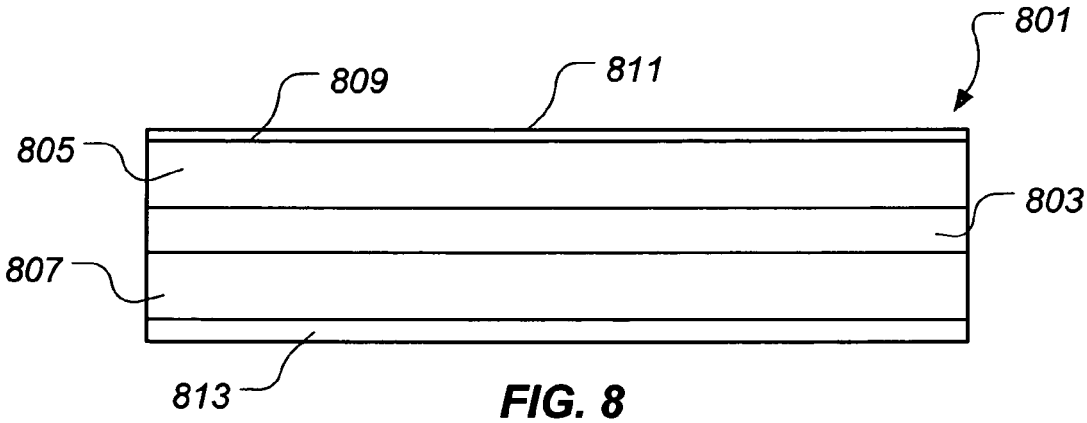
FIG. 8 is a side, elevational view of a third illustrative embodiment of a blast attenuation assembly according to the present invention.

FIG. 8 depicts a third illustrative embodiment of a blast attenuation assembly 801 according to the present invention. In the illustrated embodiment, blast attenuation assembly 801 comprises a blast attenuator 803, corresponding to blast attenuator 101, disposed between a first crushable element 805 and a second crushable element 807. Crushable elements 805, 807 correspond to crushable element 603 of FIG. 6. One or both of crushable elements 805, 807 may have constructions including corrugated web 701, depicted in FIG. 7. First crushable element 805 defines a blast-facing surface 809. First crushable element 805 partially attenuates impact forces, such as impact force 403 of FIG. 4. The non-attenuated portion of the impact force is then at least partially attenuated by blast attenuator 803. The remaining portion of the impact force, not attenuated by first crushable element 805 and blast attenuator 803, is then at least partially attenuated by second crushable element 807. Preferably, blast attenuation assembly 801 includes a face sheet 811, disposed adjacent blast-facing surface 809, and a spall liner 813. Face sheet 811 and spall liner 813 correspond to face sheet 109 and spall liner 111, respectively, of FIG. 1. Face sheet 811 and/or spall liner 813, however, may be omitted in certain embodiments.

Figure 9:
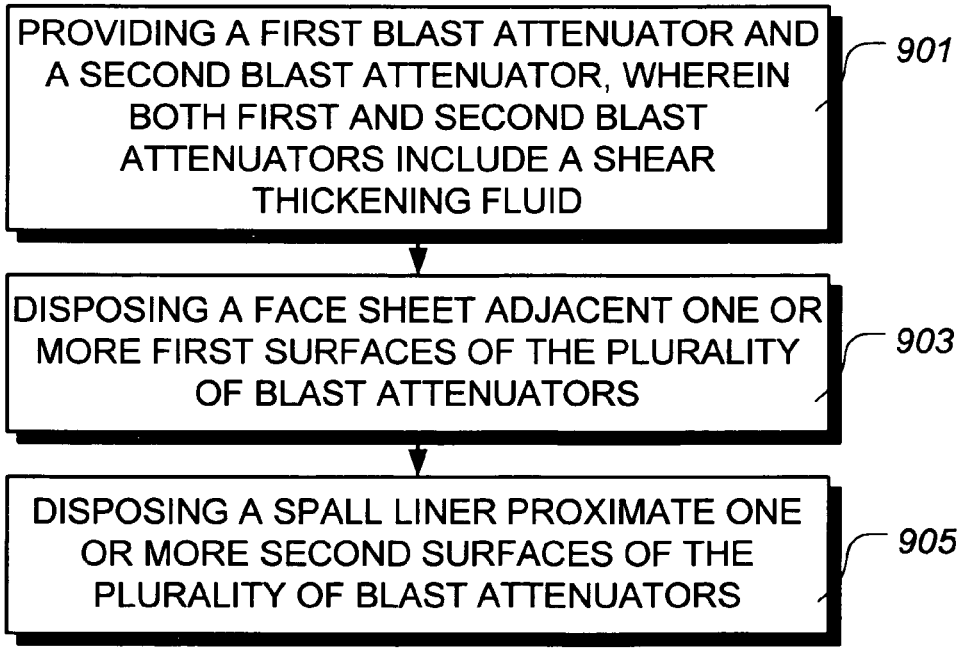
FIG. 9 is a block diagram depicting a first illustrative embodiment of a method of making a blast attenuation assembly according to the present invention.

FIG. 9 depicts a first illustrative embodiment of a method of making a blast attenuation assembly (e.g., blast attenuation assembly 501) according to the present invention. The method includes the step of providing a first blast attenuator and a second blast attenuator (e.g., blast attenuators 101), such that both first and second blast attenuators include a shear thickening fluid (e.g., shear thickening fluid 107) (block 901). The method further includes the step of disposing a face sheet (e.g., face sheet 503) adjacent one or more first surfaces of the plurality of blast attenuators (block 903) and/or the step of disposing a spall liner (e.g., spall liner 505) proximate one or more second surfaces of the plurality of blast attenuators (block 905).

Figure 10:
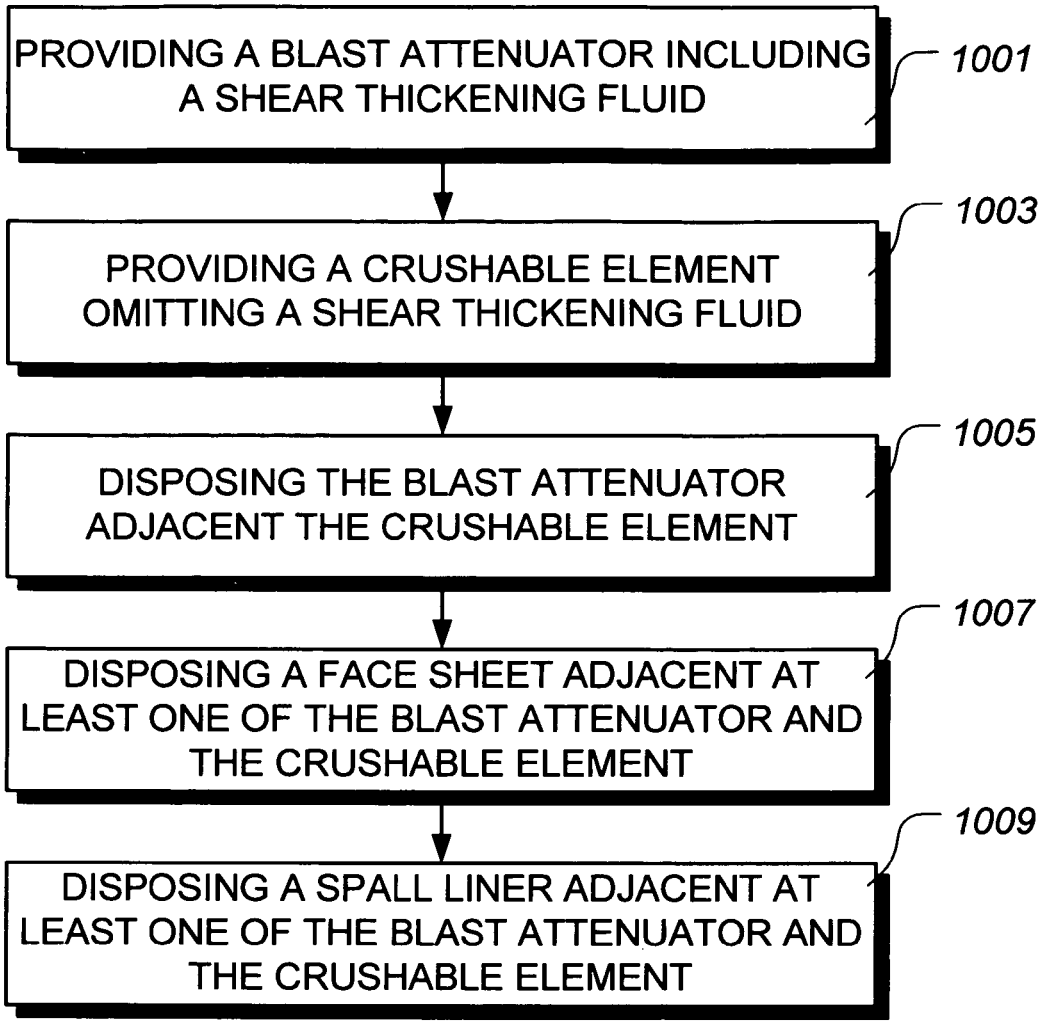
FIG. 10 is block diagram depicting a second illustrative embodiment of a method of making a blast attenuation assembly according to the present invention.

FIG. 10 depicts a second illustrative embodiment of a method of making a blast attenuation assembly (e.g., blast attenuation assembly 601 or 801) according to the present invention. The method includes the step of providing a blast attenuator (e.g., blast attenuator 101 or 803) including a shear thickening fluid (e.g., shear thickening fluid 107) (block 1001). The method further includes the step of providing a crushable element (e.g., crushable elements 603, 805, or 807) that omits a shear thickening fluid (block 1003). The method further includes the step of disposing the blast attenuator adjacent the crushable element (block 1005). The method further includes the step of disposing a face sheet (e.g., face sheet 607 or 811) adjacent at least one of the blast attenuator and the crushable element (block 1007) and the step of disposing a spall liner (e.g., spall liner 609 or 813) adjacent at least one of the blast attenuator and the crushable element (block 1009). It should be noted, however, that the scope of the present invention encompasses embodiments wherein one or both of the steps corresponding to blocks 1007 and 1009 are omitted.

Figure 11:
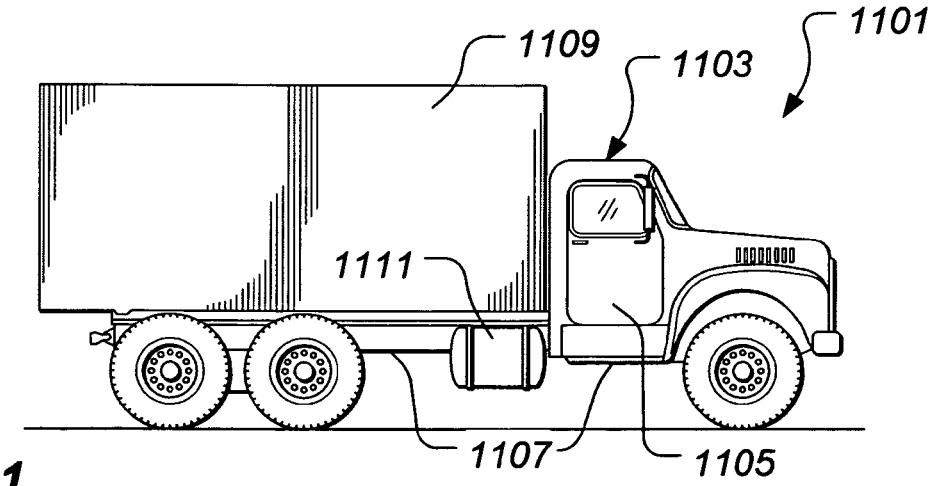
FIG. 11 is a side, elevational view of a vehicle incorporating at least one of a blast attenuator and a blast attenuation assembly according to the present invention.

A blast attenuator (e.g., blast attenuator 101 or 803) or a blast attenuation assembly (e.g., blast attenuation assembly 501, 601, or 801) of the present invention may be operably associated with a vehicle, building, or other such structure to inhibit the deleterious effects of an explosive blast on the vehicle, building, or other such structure. Accordingly, FIG. 11 depicts a vehicle 1101 in which one or more blast attenuators of the present invention and/or one or more blast attenuation assemblies of the present invention are incorporated. Vehicle 1101 includes a blast attenuator or a blast attenuation assembly in, on, or behind one or more of a cab 1103 of vehicle 1101, a door 1005 of cab 1103, an underside 1107 of vehicle 1101, a load-carrying structure 1109 of vehicle 1101, and a fuel tank 1111 of vehicle 1101. The scope of the present invention, however, is not so limited. Rather, a blast attenuator or a blast attenuation assembly operably associated with any suitable portion of vehicle 1101. Moreover, vehicle 1101 is not limited to the particular configuration illustrated in FIG. 11. Rather, vehicle 1101 may be a tank, personnel carrier, or any other device designed to transport personnel, goods, equipment, or the like from one point to another.

FIG. 12 depicts one particular embodiment of a vehicle cab 1201 according to the present invention. Cab 1201 defines a compartment 1203 in which a blast attenuator 1205, corresponding to blast attenuator 101, 803, or the like, and/or a blast attenuation assembly 1207, corresponding to blast attenuation assembly 501, 601, 801 or the like, is disposed. Note that the particular geometric configurations of blast attenuator 1205 and blast attenuation assembly 1207 are merely exemplary. Other configurations are possible and such configurations are encompassed within the scope of the present invention.

FIG. 13 depicts one particular embodiment of a building 1301 comprising a wall 1303 in which a blast attenuator 1305, corresponding to blast attenuator 101, 803, or the like, and a blast attenuation assembly 1307, corresponding to blast attenuation assembly 501, 601, 801 or the like, are disposed. In the illustrated embodiment, building 1301 comprises a plurality of blast attenuators 1305, although only one blast attenuator 1305 is indicated for clarity. It should be noted that, according to the present invention, one or more blast attenuators 1305 and/or one or more blast attenuation assemblies 1307 are operably associated with building 1301. Blast attenuators 1305 and/or blast attenuation assemblies 1307 may be disposed, for example, within building 1301, exterior to building 1301, or within wall 1303 of building 1301 to inhibit the deleterious effects of an explosive blast on building 1301 or other such structure.

It should also be noted that any of the embodiments of the blast attenuator or blast attenuation assembly disclosed herein, and their equivalents, may be operably associated with any structure. In this sense, the term "structure" means any interconnected collection of parts forming a device, apparatus, or the like, and includes, but is not limited to, a vehicle and a building.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated.

Although the present invention is shown in a limited number of forms, it is not limited to just these forms, but is amenable to various changes and modifications without departing from the spirit thereof.

What is claimed is:

1. A blast attenuator, comprising:

an enclosure defining a cavity;

a core including an open-celled foam defining a plurality of interconnected pores, the core disposed in the cavity; and a shear thickening fluid disposed in the cavity, such that the shear thickening fluid fills a portion of a pore volume of the core.

2. The blast attenuator, according to claim 1, wherein the enclosure is rupturable when exposed to an explosive blast wave.

3. The blast attenuator, according to claim 1, wherein the open-celled foam comprises a structural network defining the plurality of interconnected pores.

4. The blast attenuator, according to claim 3, wherein the open-celled foam is an open-celled metallic foam.

5. The blast attenuator, according to claim 1, wherein the core exhibits a compressive strength of at least about 400 kilopascals.

6. The blast attenuator, according to claim 1, wherein the core exhibits a density of at least about 120 kilograms per cubic meter.

7. The blast attenuator, according to claim 1, wherein the shear thickening fluid fills a majority of the pore volume of the core.

8. The blast attenuator, according to claim 1, wherein the shear thickening fluid substantially fills the pore volume of the core.

9. The blast attenuator, according to claim 1, wherein the shear thickening fluid comprises:

ethylene glycol; and silica particles dispersed in the ethylene glycol.

10. The blast attenuator, according to claim 9, wherein the silica particles exhibit an average particle size less than about 200 nanometers.

11. The blast attenuator, according to claim 9, wherein the silica particles constitute a volume fraction of at least about 0.4 of the shear thickening fluid.

12. The blast attenuator, according to claim 1, further comprising:

a face sheet disposed adjacent a first surface of the enclosure.

13. The blast attenuator, according to claim 12, wherein the face sheet is configured to inhibit progress of a ballistic projectile.

14. The blast attenuator, according to claim 1, further comprising:

a spall liner disposed adjacent a surface of the enclosure.

15. The blast attenuator, according to claim 1, wherein the blast attenuator is operably associated with a structure.

16. The blast attenuator, according to claim 1, wherein the blast attenuator is configured to form a portion of a structure.

17. The blast attenuator, according to claim 1, wherein the blast attenuator is operably associated with at least one other blast attenuator, the at least one other blast attenuator including a shear thickening fluid.

* * * * *